US005638559A

United States Patent [19]

Natri et al.

[11] Patent Number: 5,638,559

[45] Date of Patent: Jun. 17, 1997

[54] BERTH ARRANGEMENT

[75] Inventors: Veikko Natri, Espoo; Juhani Särkkä, Littoinen; Per Flythström, Svartå, all of Finland

[73] Assignee: Kvaerner Masa-Yards Oy, Helsinki, Finland

[21] Appl. No.: 652,916

[22] Filed: May 23, 1996

[30] Foreign Application Priority Data

May 24, 1995 [FI] Finland ..... 952553

[51] Int. Cl.[6] ..... A47C 17/33

[52] U.S. Cl. ..... 5/10.2; 5/118

[58] Field of Search ..... 5/10.1, 10.2, 118, 5/164.1; 114/188, 192; 296/174

[56] References Cited

U.S. PATENT DOCUMENTS

| | | | |
|---|---|---|---|
| 2,632,183 | 3/1953 | Patton et al. | 5/10.2 |
| 3,480,975 | 12/1969 | Racine et al. | 114/192 |
| 5,353,452 | 10/1994 | Rulis | 5/164.1 |
| 5,461,735 | 10/1995 | Danton | 5/10.2 |

FOREIGN PATENT DOCUMENTS

| | | |
|---|---|---|
| 271789 | 6/1969 | Austria . |
| 400094 | 9/1995 | Austria . |
| 85555 | 1/1992 | Finland . |
| 591 | 1/1993 | Finland . |
| 21 43 926 | 3/1972 | Germany . |
| 2 056 426 | 6/1972 | Germany . |
| 473 558 | 7/1969 | Switzerland . |
| 634977 | 3/1983 | Switzerland . |

*Primary Examiner*—Michael F. Trettel
*Attorney, Agent, or Firm*—Smith-Hill and Bedell

[57] ABSTRACT

A berth arrangement for installation in a sleeping compartment having a ceiling formed with a downwards open recess, comprises a berth holder and a bearing for mounting the berth holder for turning relative to the ceiling structure between a generally horizontal retracted position and a generally vertical lowered position. A berth is journalled in the holder to be turnable when the holder is in its lowered position between an extended position, in which the berth extends substantially horizontally away from the holder, and a folded up position, in which the berth is disposed substantially vertically and is close to the holder. A first gas spring is effective against the holder for exerting, over substantially the entire range of angular movement of the holder, a torque that tends to turn the holder in the direction from its lowered position toward its retracted position and increases as a function of the angle through which the holder turns in the direction from its lowered position toward its retracted position over substantially the entire range of angular movement of the holder. A second gas spring is effective between the holder and the berth and exerts a torque that tends to turn the berth in the direction from its extended position toward its folded up position.

18 Claims, 1 Drawing Sheet

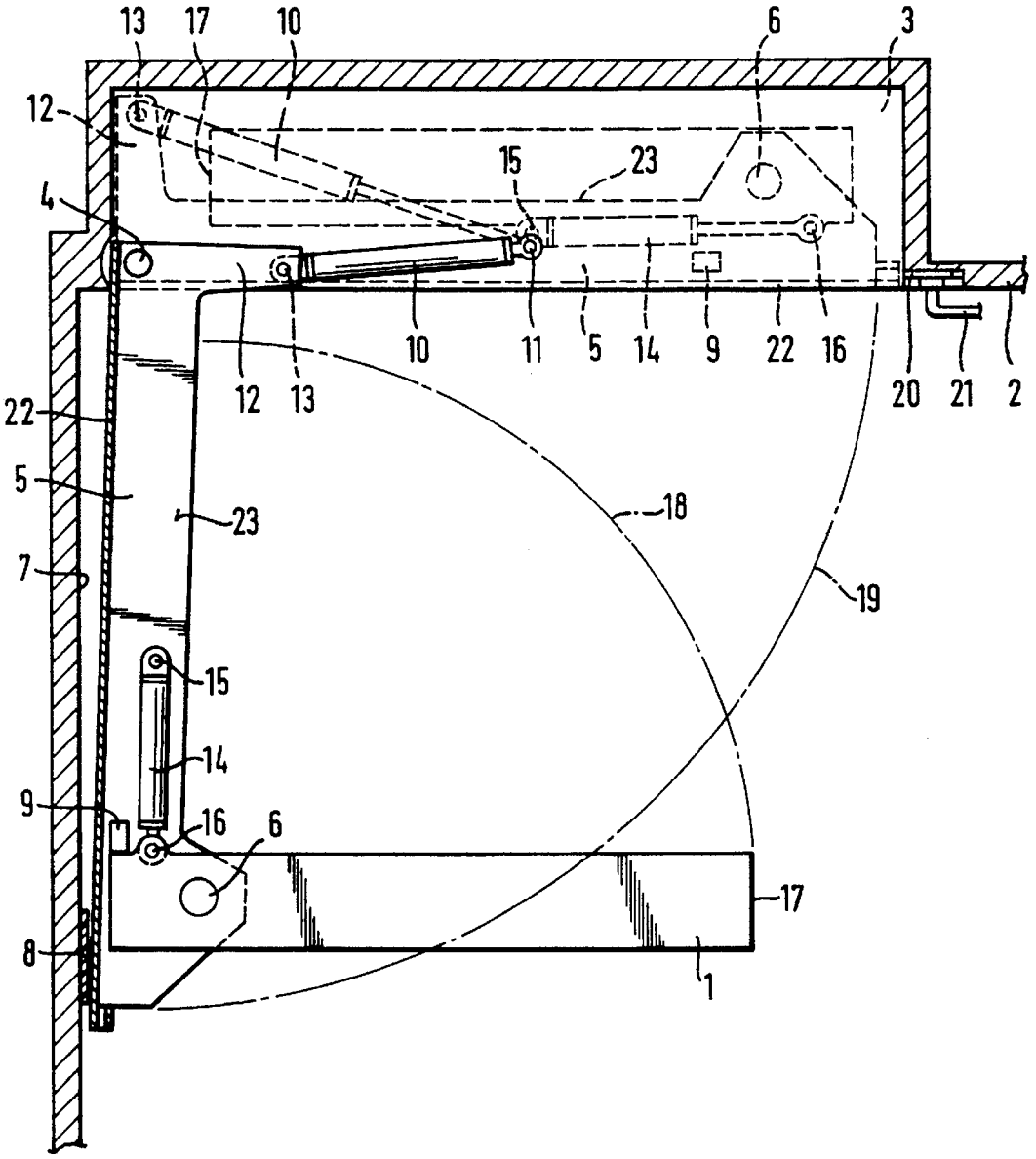
13
17
10
6
3
12
15
23
4
10
11
5
14
9
22
16
20
21
2
12
13
22
5
23
18
7
19
15
14
9
16
6
17
8
1

BERTH ARRANGEMENT

BACKGROUND OF THE INVENTION

This invention relates to a berth arrangement.

In compartments used for sleeping, for example in passenger cabins of ships, it is known to use berths that may be lowered from the ceiling. The passenger accommodation areas of the passenger ship *Santa Rosa* (nowadays *S/S Regent Rainbow*) were renewed in 1990 and the ceilings of the cabins were provided with such berths. Typical for this kind of berth structure is that the berth is supported by a holder that is turnably journalled in the ceiling. The berth is moved from a use position to a position retracted into the ceiling, by first turning the berth 90° towards the holder and then turning the holder together with the berth 90° upwards.

The torque exerted by a berth of the kind used in the *Santa Rosa* as it is turned towards the holder decreases as a function of the angle through which it has been turned, and the torque exerted by the holder and berth combination as it is turned upward increases as a function of the angle through which the combination has been turned. In the *Santa Rosa*, these movements were facilitated by a wire mechanism. Patent Application FI 942972 (a parallel to U.S. Pat. No. 5,461,735) shows a similar berth mechanism, the movements of which are controlled by means of jacks. Patent publication NL 7415980 shows a similar berth mechanism where the movements are facilitated by means of a balance weight. Several patent publications such as CH 473558 and DE 2143926 show simple berth arrangements, where a berth is foldable out from a fixed wall holder. The movements of the berth are facilitated by pneumatic spring cylinders, but the application of these cylinders is complicated, which underlines the complexity of the problems involved.

SUMMARY OF THE INVENTION

In order to keep to a minimum the external forces required on the part of a passenger or staff member for moving a berth of the kind used in the *Santa Rosa* between its position of use and its retracted position, it is necessary to provide counterbalance torques that vary as a function of the angular position of the berth and the combination of the holder and berth.

The object of the invention is to provide an easy-to-use berth arrangement which is retractable into the ceiling. The structure of the arrangement should be as simple as possible.

Gas springs of the kind known per se are used in a berth mechanism according to the invention. The gas springs may be of the type manufactured and sold by the German firm Stabilus GmbH of Koblenz, Germany. The gas springs are applied to automatically generate forces and torques at least mainly balancing the forces and torques caused by gravity. Hence, the berth may be lowered to a use position and lifted to a retracted position with only a very small external force. The gas springs may also have the effect that the moving parts of the berth arrangement reliably stay in their desired end positions.

In a preferred embodiment of the invention, the holder includes, at both ends of the berth, a stiffening element turnably journalled close to the ceiling. At a distance of at least 150 mm, preferably at least 180 mm, from the holder's turning axis the stiffening elements each have a loading point, to which a gas spring element is attached. Since the distance from this point to the turning axis of the holder is of the magnitude mentioned, gas springs with a relatively small spring force may be used to exert a substantial torque.

Smaller gas springs are less expensive than large gas springs, they have a small diameter and they only take up a small space. When the holder and berth combination is in its retracted position, the torque exerted on the holder by each of the gas springs should be at least 120 Nm, preferably about 150 Nm. Then the holder and berth combination is fully or almost fully balanced in its retracted position. Nevertheless, it is recommended to provide a locking device for securing the holder and berth combination in the retracted position. If only the staff has a key to the locking device, unauthorized use of the berth is prevented.

The gas springs that influence the turning movement of the holder and berth combination should each have one end turnably journalled at a fixed point close to the ceiling, preferably inside a recess in the ceiling, where the berth can be concealed when not in use. When the holder is in its lowered position, this fixed point should preferably be approximately in line with the loading point and the turning axis of the holder. Then the torque exerted by these gas springs is approximately at its smallest value when the holder is in its lowered position and is approximately at its greatest value when the holder is in its retracted position. This makes it easy to lift up the holder and berth combination into the ceiling recess, because this action requires only a slight force.

It is of further advantage to install the gas springs so that when the holder is in its lowered position, the action direction of the gas springs is at a small perpendicular distance, that is some centimeters, from the turning axis of the holder at a side thereof causing a torque keeping the holder and berth combination securely in its lowered position.

The gas springs acting directly on the berth are preferably so arranged that they exert their force at a point of the berth which, when the berth is in its position of use, is between the berth's turning axis and the holder. The force of these gas springs then efficiently acts in a direction lifting the berth, and in addition, the gas springs themselves do not form an additional load when the berth is folded up towards its intermediate position against the holder.

For better safety in use, the gas springs acting directly on the berth are arranged to act at a point of the berth which is at least approximately at the same horizontal distance from the turning axis of the berth when the berth is in its use position as when the berth is folded up against the holder. In this manner the berth remains reliably in its position folded up against the holder.

If the turning axis of the berth is sufficiently far from the edge of the berth, the gas springs acting directly on the berth may have a relatively long torque radius. This makes it possible to use small springs with a spring force even smaller than one half of the force of each of the gas springs acting on the holder. This reduces not only the weight of the holder and berth combination, but also the price of the gas springs. If, for example, the distance of the turning axis of the berth from the berth's closest longitudinal edge is at least 10 cm, preferably at least 13 cm, the gas springs of the berth can easily be given a long torque radius and then they do not have to have a great spring force. Further, this position of the turning axis results in the torque acting on the berth due to the weight of the user being moderate, or at least less than if the turning axis were closer to the edge of the berth.

It is recommended that the gas springs of the berth are arranged so that throughout the range of angular positions of the berth, from its use position to its folded up intermediate position, they exert a torque turning the berth towards the holder. In the use position of the berth, the weight of the berth overcomes the torque exerted by the gas springs of the berth and keeps the berth in position. Turning the berth against gravity towards the holder is facilitated by the torque of the gas springs and may thus be carried out with little external force through the entire range of angular movement of the berth.

At least the gas springs acting on the holder are preferably so called linear springs, having a spring force that is at the most only to a slight degree dependent on the extension/compression position of the spring. Hence, an almost uniform gas spring force is available over the entire working range of the gas spring. Consequently, the torque exerted is influenced mainly only by the perpendicular distance between the acting direction of the force and the actual turning axis. The gas springs acting only on the berth do not have to be linear, because when the berth is folded up towards the holder, no great force is needed for keeping the berth in position.

BRIEF DESCRIPTION OF THE DRAWINGS

The invention will now be described more in detail with reference to the accompanying drawing, the single FIGURE of which schematically shows a cross-section of a berth arrangement according to the invention.

DETAILED DESCRIPTION

In the drawing, 1 indicates a movable berth having a retracted position in which it is accommodated in a recess 3 in the ceiling 2 of a sleeping compartment, for example a ship's cabin, a sleeping compartment on a railroad train, or a worker accommodation unit in a work camp. The sleeping compartment may be implemented as a substantially self-contained construction unit that is built at a construction site and transported to an installation site, such as a shipyard, for installation in a larger structure and connection to utility supplies, such as electricity and water. Dashed lines show the positions of the movable parts when the berth 1 is in its retracted or stored position, and full lines show the positions of the parts when the berth is in its lowered or deployed position. Close to one longitudinal side of the recess 3 there are bearings 4, in which a holder 5 carrying the berth 1 is turnably journalled relative to the stationary structure of the cabin. The berth is turnably journalled in the holder 5 by means of bearings 6.

The berth 1 is provided with a normal size bed mattress and other bed clothes, not shown in the drawing. In the lowered position of the holder 5 its lower edge contacts a support or buffer structure 8, for example a thick plastic strip attached to a nearby wall 7, for limiting angular movement of the holder 5 in the clockwise direction. The plastic strip also protects the wall from damage. The holder 5 includes a stopper 9 that limits the movement of the berth 1 in the clockwise direction relative to the holder and supports the berth when it is folded out to its horizontal use position.

The holder 5 includes a back wall 22 attached to stiffening and force transmission elements 23 at both its shorter ends. In the retracted position of the berth, the wall 22 covers the opening of the recess 3, so that a uniform ceiling surface is formed leaving the entire berth arrangement fully concealed.

For facilitating movement of the holder 5 and the berth 1 between use position and retracted position, there are, close to the two opposite end walls of the recess 3, respective gas springs 10. Each of the gas springs 10 is journalled at one end in a bearing at a fixed point 11 of the respective end wall, and at its opposite end in a bearing at a point 13 of a protrusion 12 rigid with the element 23 at the respective end of the holder 5.

For balancing the torque caused by the weight of the berth 1 and the accessories contained therein, there is a gas spring 14 at each end of the berth 1. Each of these springs 14 is at one end, journalled at a point 15, fixed relative to the holder 5 and at the opposite end is journalled at a point 16 of the berth. The point 16 is between the turning axis 6 of the berth 1 and the back wall 22 of the holder 5 and close to the upper level of the berth 1 when the berth is in its position of use.

For moving the holder and berth combination from the deployed position to the retracted position in the recess 3, the berth 1 is first lifted from its outer edge 17 upwards to fold it up towards the holder 5. The motion path of the outer edge 17 of the berth is shown by an arc 18. This folding movement is essentially facilitated by the force generated by the two gas springs 14. The torque provided by the springs 14 should be such that the external tangential force needed at the outer longitudinal edge of the berth to retain the berth at any angular position on the arc 18 should be no greater than 5 kg, preferably no greater than 2 kg, and more preferably no greater than 1 kg.

In the next phase the combination of the holder 5 and the berth 1 is turned guided by its bearings 4 into the recess 3. The motion path of the lower end of the stiffening portions 23 is shown by an arc 19. Lifting of the combination of the holder 5 and the berth 1 is essentially facilitated by the force generated by the gas springs 10. The torque exerted by the gas springs 10 relatively closely matches the torque exerted by the combination 1, 5 throughout its range of angular movement. At the very beginning of the lift, the torque exerted by the gas springs 10 relative to the bearings 6 is very small and directed downwards (clockwise). At the beginning of the lift, the effect of gravity is insignificant, but immediately thereafter the direction of the torque exerted by the gas springs 10 changes direction (becomes counter-clockwise) and grows rapidly as the lift proceeds. Because the distance between the holder's turning axis 4 and the point 13 is rather great, at least 150 mm, a reasonably powerful gas spring 10 generates a substantial torque facilitating the lift. The torque exerted by the gas springs 10 should be such that the external tangential force needed at the outer edge of the holder to retain the combination at any angular position on the arc 19 within a sector of at the most 75° from the holder's fully retracted position should be no greater than 5 kg, preferably no greater than 2 kg, and more preferably no greater than 1 kg.

When the holder and berth combination has reached its retracted position, a latch device 20 may be engaged to ensure that the holder and berth combination reliably remains in the recess 3. The latch device 20 may have a removable turning handle 21. The latch device may be either in the holder 5 or in the ceiling 2.

A latch device may also be provided for retaining the holder 5 in its lowered position. This latch device may be engaged and disengaged automatically in response to movement of the berth respectively to and from its use position and may have parts in common with the latch device 20. For instance, the same opening in the holder may receive alternatively a latch member located in the vicinity of the buffer structure 8 for retaining the holder in the lowered position or a latch member located in the vicinity of the recess 3 for retaining the holder in the retracted position.

It is evident from the drawing that the torque exerted by the practically linear gas spring 10 has its maximum value when the holder and berth combination is just below its retracted position. The value of the maximum torque exerted by the gas spring is selected relative to the torque exerted by the holder and berth combination such that when the latch device 20 is released, the holder rotates slightly toward the lowered position. It is then easy to grasp the holder and pull it down farther toward the lowered position. This arrangement also gives a visible indication of whether the latch device 20 is engaged.

The invention is not limited to the embodiment shown, but several modifications thereof are feasible within the scope of the attached claims.

We claim:

1. A berth arrangement for installation in a sleeping compartment having a ceiling formed with a downwards open recess, said berth arrangement comprising:

a berth holder, a bearing means for mounting the berth holder for turning relative to the ceiling structure about a turning axis, the berth holder turning between a generally horizontal retracted position and a generally vertical lowered position, a berth journalled in the holder to be turnable when the holder is in its lowered position about a turning axis, the berth turning between an extended position, in which the berth extends substantially horizontally away from the holder, and a folded up position, in which the berth is disposed substantially vertically and is close to the holder, a first gas spring means effective against the holder for exerting, over substantially the entire range of angular movement of the holder, a torque that tends to turn the holder in the direction from its lowered position toward its retracted position and increases as a function of the angle through which the holder turns in the direction from its lowered position toward its retracted position over substantially the entire range of angular movement of the holder, and a second gas spring means effective between the holder and the berth and exerting a torque that tends to turn the berth in the direction from its extended position toward its folded up position.

2. An arrangement according to claim 1, wherein the first gas spring means is effective against the holder at a distance of at least 150 mm from the turning axis of the holder.

3. An arrangement according to claim 1, wherein the second gas spring means is installed between a loading point on the berth and a fixed bearing point on the holder, and wherein when the berth is in its extended position, the loading point on the berth is between the holder and the turning axis of the berth.

4. An arrangement according to claim 3, wherein the second gas spring means acts on the berth at a loading position such that the lateral distance between the loading position and the turning axis of the berth is approximately the same when the berth is in its folded up position as when it is in its extended position.

5. An arrangement according to claim 1, wherein the spring force of the second gas spring means is less than approximately half of the spring force of the first gas spring means.

6. An arrangement according to claim 1, wherein the first gas spring means comprises at least one so-called linear gas spring.

7. An arrangement according to claim 1, wherein the berth has first and second longitudinal edges that are respectively nearer and farther from the holder when the berth is in its extended position, and the turning axis of the berth is at least 13 cm from the first longitudinal edge of the berth.

8. An accommodation unit having a ceiling structure formed with a downwards open recess and a berth arrangement installed in said recess, said berth arrangement comprising:

a berth holder, a bearing means supporting the berth holder for turning relative to the ceiling structure about a turning axis, the berth holder turning between a generally horizontal retracted position and a generally vertical lowered position, a berth journalled in the holder to be turnable when the holder is in its lowered position about a turning axis, the berth turning between an extended position, in which the berth extends substantially horizontally away from the holder, and a folded up position, in which the berth is disposed substantially vertically and is close to the holder, a first gas spring means effective between the ceiling structure and the holder and exerting, over substantially the entire range of angular movement of the holder, a torque that tends to turn the holder in the direction from its lowered position toward its retracted position and increases as a function of the angle through which the holder turns in the direction from its lowered position toward its retracted position over substantially the entire range of angular movement of the holder, and a second gas spring means effective between the holder and the berth and exerting a torque that tends to turn the berth in the direction from its extended position toward its folded up position.

9. An accommodation unit according to claim 8, wherein the first gas spring means is effective against the holder at a distance of at least 180 mm from the turning axis of the holder.

10. An accommodation unit according to claim 8, wherein the first gas spring means is so dimensioned that when the holder is in its retracted position, the first gas spring means exerts a torque on the holder that is at least 240 Nm.

11. An accommodation unit according to claim 8, wherein the first gas spring means is connected between a fixed bearing point of the ceiling structure and a loading point of the holder, and the fixed bearing point of the ceiling structure is so arranged that when the holder is in its lowered position, the loading point of the holder is approximately in line with the fixed bearing point of the ceiling structure and the turning axis of the holder.

12. An accommodation unit according to claim 11, wherein, when the holder is in its lowered position, the loading point of the holder lies slightly off the line joining the fixed bearing point of the first gas spring means and the turning axis of the holder, thereby exerting a holding torque keeping the holder in its fully lowered position.

13. An accommodation unit according to claim 8, wherein the second gas spring means is installed between a loading point on the berth and a bearing point on the holder, and wherein when the berth is in its extended position, the loading point on the berth is between the holder and the turning axis of the berth.

14. An accommodation unit according to claim 13, wherein the second gas spring means acts on the berth at a loading point such that the lateral distance between the loading point and the turning axis of the berth is approximately the same when the berth is in its folded up position as when it is in its extended position.

15. An accommodation unit according to claim 8, wherein the spring force of the second gas spring means is less than approximately half of the spring force of the first gas spring means.

16. An accommodation unit according to claim 8, wherein the first gas spring means comprises at least one so-called linear gas spring.

17. An accommodation unit according to claim 8, wherein the berth has first and second longitudinal edges that are respectively nearer and farther from the holder when the berth is in its extended position, and the turning axis of the berth is at least 10 cm from the first longitudinal edge of the berth.

18. An accommodation unit according to claim 8, wherein the first gas spring means is so dimensioned that when the holder is in its retracted position, the first gas spring means exerts a torque on the holder that is at least 300 Nm.

* * * * *